United States Patent [19]

Best et al.

[11] 4,294,093

[45] Oct. 13, 1981

[54] PIN TUMBLER LOCK WITH PULL-RESISTANT KEY PLUG

[75] Inventors: Walter E. Best; William R. Foshee; Max L. Flack, all of Indianapolis, Ind.

[73] Assignee: Best Lock Corporation, Indianapolis, Ind.

[21] Appl. No.: 48,531

[22] Filed: Jun. 14, 1979

[51] Int. Cl.[3] ..... E05B 27/00

[52] U.S. Cl. ..... 70/369; 70/451; 70/452

[58] Field of Search ..... 70/381, 452, 375, 369, 70/373, 451

[56] References Cited

U.S. PATENT DOCUMENTS

| | | | |
|---|---|---|---|
| 1,564,463 | 12/1925 | Best . | |
| 3,206,959 | 9/1965 | Best . | |
| 3,548,621 | 12/1970 | Rossetti . | |
| 3,665,740 | 5/1972 | Taniyama | 70/375 |

FOREIGN PATENT DOCUMENTS

| | | | |
|---|---|---|---|
| 2703058 | 7/1978 | Fed. Rep. of Germany | 70/375 |

OTHER PUBLICATIONS

"Falcon" Core-Walter E. & Best Fosher; William R. Foshee Case B-161 (sketch).

*Primary Examiner*—Robert L. Wolfe

*Attorney, Agent, or Firm*—Jenkins, Coffey, Hyland, Badger & Conard

[57] ABSTRACT

A key-removable lock core of the same size as a standard core, to fit standard core receptacles, and having a key plug of improved pull resistance. The core body of figure-8 cross section has a key plug lobe which contains a sleeve having a core retainer lug movable by a control key between a projected core retaining position and a retracted core release position. A key plug having an enlarged rear head is inserted from the rear into the cylindrical bore defined by the sleeve, with the head overlapping the rear of both the sleeve and the key plug lobe of the body. A segment is inserted in a slot traversing the key slot and is trapped therein by the sleeve to form a key stop. The key plug is held in place by a C-shaped retaining ring in a circumferential groove in such plug at the front face of the body, and is trapped in place by a face plate fixed to the body by a blind annular rivet. Beside increasing the plug pull resistance, the construction gives improved dimensional control and accuracy of assembly and eliminates a previously required step of counterboring the face plate after its assembly to the core body.

14 Claims, 6 Drawing Figures

PIN TUMBLER LOCK WITH PULL-RESISTANT KEY PLUG

This invention relates to lock construction, especially to the construction of the key plug and its mounting in a pin tumbler lock mechanism to improve the resistance of the key plug to forced pulling of the plug out of the lock.

The invention is especially applicable and is disclosed as applied to a key-removable core of the type shown in U.S. Pat. Nos. 1,564,463 of Dec. 8, 1925 and 3,206,959 of Sept. 21, 1963. As there shown, the key-removable core comprises a body of figure-8 cross section having a lower lobe which is bored to receive a thin cylindrical sleeve having an upstanding boss that forms a core-retaining lug. A key plug is inserted from the front in the bore of the sleeve and is held axially therein by engagement of a flange on the key plug in a counterbore in the face plate of the core, and by a key stop plate fixed to the rear end of the plug by rivets integral with the key plug. Cores of this type have become a standard in the industry and are of advantage in that they can be readily removed from and replaced in a lock cylinder, padlock, doorknob, or other core receptacle by using a special control key to rotate the sleeve and retract the core-retaining lug. There are many thousands of such applications in existence in which key removal and replacement of such a standardized core is useful.

In recent years, pin tumbler locks have been subject to forced pulling attack by a procedure in which a hardened screw is threaded into the key slot of the key plug, and pulling force is applied either continuously or with an impact puller so as to pull the key plug out of the lock.

It is the general object of the present invention to increase the pull resistance of the key plug in a pin tumbler lock, and especially in a key-removable core of the type described, and to do so while maintaining the standard configuration and dimensions of the standard core so that the improved core will fit the same core receptacles as the prior standard core. The present invention not only accomplishes this purpose, but also improves the dimensional control and ease of manufacture and assembly of the core.

In accordance with the invention, the core body and sleeve are made substantially as before, but the core plug is formed with an integral heavy peripheral flange or head at its rear end, wide enough to engage both the sleeve and the lower lobe of the core body from the rear so as to strongly oppose forward pull on the plug. The plug is axially broached to form a key slot, and a key stop is formed by inserting a small disk segment in a cross slot ahead of the rear flange so that it is trapped in such slot by the surrounding sleeve. The forward end of the key plug is formed with a peripheral groove in which a C-shaped retaining ring is mounted. The ring overlaps the sleeve and core body at the front so as to hold the plug against rearward movement. The C-shaped ring defines a key-pass opening and is held with such opening in alignment with the key slot. A face plate is secured to the front of the body by a known blind riveting operation. The face plate has an internal counterbore which surrounds the retaining ring and traps it permanently in place.

In manufacture, the inner face of the rear flange and the retaining ring groove can both be made or finished in the same operation so that their spacing is held to exact dimensions, and the core body and sleeve can be accurately finished to a corresponding dimension so that an accurate interfitting relationship can be obtained between the parts; and it is not necessary to counterbore the face plate after its assembly to the core body as was done to obtain a suitable length dimension in prior standard cores. The body, sleeve, and plug can be preassembled for purposes of drilling the tumbler pin holes, and the parts then disassembled to clear out burrs and chips, whereas this could be done with prior standard cores because they required the key stop to be riveted to the key plug in place before the tumbler pin holes are drilled, in order to prevent misalignment of such holes resulting from the riveting operation. After the body and sleeve and plug have been thus prepared, they are finally assembled and the retaining ring applied. The face plate is then fixed to the body and permanently traps the ring in place.

With prior standard cores, production of a plated front requires plating after assembly of the key plug in the body because of the requirements mentioned above. In consequence, plating metal is deposited in clearance spaces, which causes binding and requires special lubricant. With the present invention, a plated front can be obtained by plating the parts separately and before assembly, which avoids such problems.

Whereas the plug in the prior standard core was subject to pulling failure and does not meet a proposed standard strength test, the plug and core construction of the present invention provides a plug having a pull resistance substantially exceeding the proposed standard.

The accompanying drawings illustrate the invention and show an embodiment of the best mode of carrying out the invention as presently perceived. In such drawings.

Figure 1:
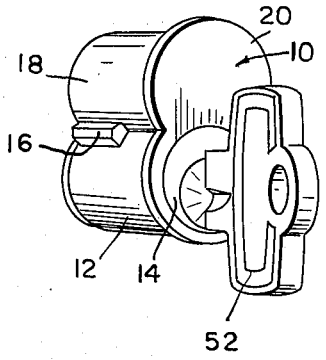
FIG. 1 is a perspective view of a key-removable core embodying the invention and which has an external appearance which is substantially the same as the prior standard core.

The core 10 shown in FIGS. 1 and 3–6 is of figure-8 cross section and has a lower lobe 12 which contains the key plug 14 and a sleeve 42 that carries a core-retaining lug 16, and has an upper lobe 18 which contains the pin tumblers and their biasing springs. The core also has a face plate 20 with a solid upper lobe and with a circular lower lobe portion 21 which surrounds the front end of the key plug 14.

Figure 2:
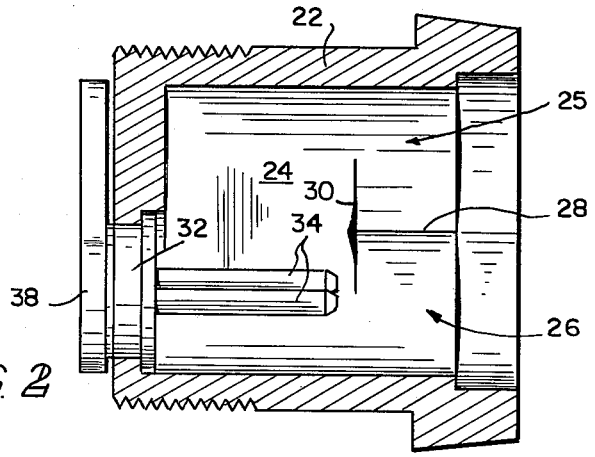
FIG. 2 is a sectional view of a known lock cylinder formed to receive a key-removable core of a standard configuration as shown in FIG. 1.

Such core is adapted to be mounted in a standard receptacle such as the cylinder shown in FIG. 2. This comprises a generally cylindrical body 22 having a core-receiving chamber 24 defined by two parallel overlapping axial bores 25 and 26 which leave between them at their sides inwardly projecting ribs 28. At their inner ends, such side ribs 28 are milled away so as to define rearwardly presented shoulders 30 at the two sides of the chamber. The core-retaining lug 16 of the core 10 is adapted to be projected behind such a shoulder 30 to retain the core in the chamber 24. The rear wall of the cylinder is formed with a shouldered opening in which a throw member 32 is rotatably mounted. The throw member 32 carries a pair of diametrically-spaced throw pins 34 which take into corresponding eccentric bores 36 in the rear of the key plug. (See FIG. 5.) The throw member and throw pin assembly is fixed to a cam 38 for transmitting key-plug rotation to a secondary lock mechanism, as is known in the art, and as shown in U.S. Pat. No. 1,564,463.

Figure 3:
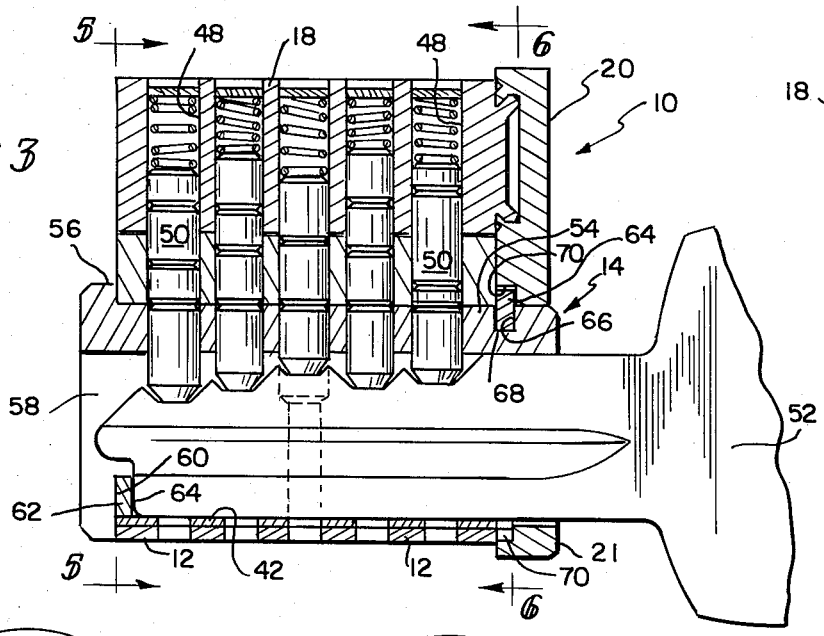
FIG. 3 is an axial sectional view of a core in accordance with the present invention.
Figure 5:
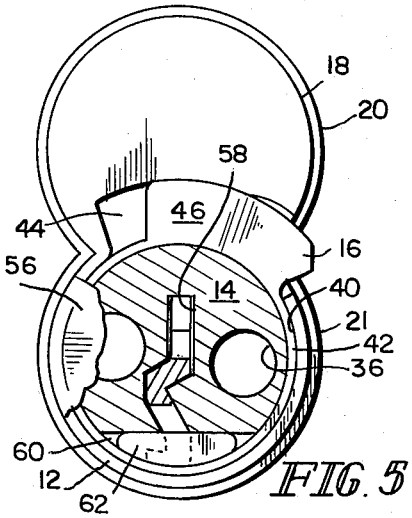
FIG. 5 is a section on the line 5—5 of FIG. 3, with a portion of the key plug shown in end elevation.
Figure 6:
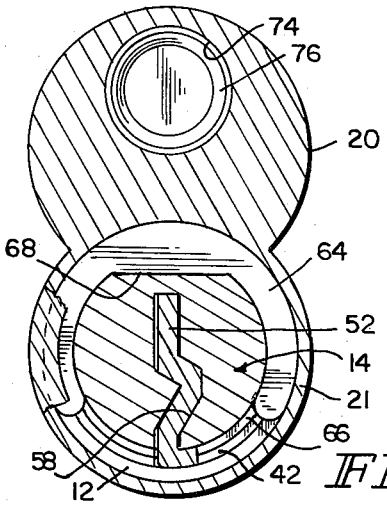
FIG. 6 is a section taken on the line 6—6 of FIG. 3.

As shown in FIGS. 3, 5, and 6, the lower lobe 12 of the core body is formed with a cylindrical bore 40 in which the thin-walled sleeve 42 is mounted for limited rotation. The bore 40 is in open communication with a wide fantail slot 44 formed in the upper lobe 18. At the rear of the core body, the side wall of the slot 44 is milled away as shown in FIG. 5, to pass the retaining lug 16 which is formed integral with a boss 46 on the sleeve 42. The limited rotation of the sleeve moves the lug 16 between a projected, core-retaining position as shown and a retracted release position.

The key plug 14 is rotatably mounted within the sleeve 42. Pin tumbler bores 48 extend downward from the top of the upper lobe 18 through that lobe and through the boss 46 on the sleeve 42 and into the key plug 14, in the usual fashion. The interface between the key plug 14 and the boss 46 defines an operating shear line at which abutting faces of pin tumbler segments 50 in those bores can be brought into registry by use of a suitable operating key 52, to permit the key plug to be rotated for usual key operation of the lock. The interface between the upper lobe 18 and the boss 46 defines a control shear line at which pin tumbler faces can be brought into registry by the use of a special control key so as to permit the control key to rotate the sleeve 40 and its boss 46 and the retaining lug 16 from its projected position shown to a retracted release position for purposes of releasing the core for inserting and removing the core from a core chamber such as the core chamber 24 of the cylinder shown in FIG. 2.

In accordance with the present invention, the key plug 14 comprises a cylindrical body portion 54, desirably made from solid stock, which extends completely through the sleeve 42 and has a close working fit within that sleeve. The rear end of the plug carries an integral heavy peripheral flange 56 which forms a rear head on the key plug 14 and which overlaps the end of the sleeve 14 and at least a substantial portion of the rear end face of the core body formed by the two lobes 12 and 18. As shown in FIGS. 3 and 5, such flange 56 desirably extends outward substantially to the periphery of the lower lobe 12. The front face of the flange 56 lies in engaged relation with the rear face of the core body and sleeve over a substantial peripheral area thereof, so that it fixes the axial position of the plug in the core and opposes forward pull on the plug 14.

The plug 14 is formed with an axial broached key slot 58. For purposes of providing a key stop at the rear end of such key slot, a shallow transverse slot 60 is cut in the cylindrical body portion 54 of the key plug at or close to the front face of the flange 56. A small disk segment 62 is inserted in that slot and has an outer cylindrical edge which substantially conforms to the circular cross section of the key plug body 54. When the segment 62 is in place in the cross slot 60 and the key plug is inserted in its bore, such segment is trapped in place by the surrounding wall of the sleeve 42. It thus stands across the key slot 58 to form a key stop for engagement for a key stop shoulder 64 at the end of a key 52 as shown in FIG. 3.

The key plug 14 is retained and held against rearward movement by a C-shaped retaining ring 64 received in a circumferential groove 66 aligned with the front face of the core body 12, 18, as shown in FIG. 3. The space between the ends of the retaining ring 64 forms a key-pass opening and this is disposed so as to clear the key slot 58, and the retaining ring is held from rotation across such slot as by forming the groove 66 with a flat upper portion 68 and forming the ring 64 with a portion which fits against that flat 68.

The retaining ring 64 is trapped in place and concealed by the face plate 20. This has a peripheral portion 21 which surrounds the front end of the key plug 14, and such portion is counterbored from the rear to provide a rabbet groove 70 which fits over the peripheral edge of the retaining ring 64 with sufficiently close clearance to prevent escape of that ring from the key plug groove 66.

Figure 4:
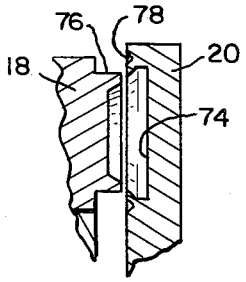
FIG. 4 is a fragmental view illustrating the blind rivet fastening of the face plate.

The face plate must of course be applied after the retaining ring 64 has been mounted on the key plug 14, and is desirably mounted by a blind annular rivet as shown in FIG. 4. The upper lobe of the face plate 20 is formed in its rear face with a circular cavity 74, and the upper lobe 18 of the core body is formed with an annular rib 76 of tapered cross section and having a cylindrical outer face. The cylindrical wall of the cavity 74 in the face plate 20 is deformed inward by a staking operation which forms a groove 78 in the rear face of the face plate 20, circumferentially about the cavity 74. The face plate 20 is then forced against the circular rib 76 so as to flatten that rib and deform it outward into the undercut periphery of the cavity 74. This securely fixes the face plate 20 onto the core body and holds the lower lobe of such face plate in position surrounding the retaining ring 64, as shown in FIG. 3. This permanently traps the retaining ring 64 in place so as to hold the key plug 14 in the assembly.

The construction described substantially simplifies the manufacture and the accuracy and convenience of assembly of a lock core in comparison with that of the prior standard core. In such prior standard core, the key plug had a shoulder at the front which seated in a counterbore in the face plate of the core, and the plug was held in place by a stop plate riveted to the rear face of the plug. In order to obtain satisfactory accuracy and avoid misalignment of the parts, especially of the pin tumbler bores, it was considered necessary to counterbore the face plate after its assembly with the core body, so as to obtain an accurate dimension from the bottom of the front counterbore to the back face of the assembly, and to make that dimension fit the corresponding dimension of the key plug between its front flange and rear face. The counterboring operation requires precise control if it is to produce the necessary dimensional accuracy, because of build-up of tolerances. It was also considered necessary to install the sleeve and key plug in this assembly and rivet the rear plug-retaining key stop against the rear face of the key plug before drilling the pin segment bores, since riveting after such drilling was found to create misalignment of the pin segment bores. In the present construction, the front face of the rear flange 56 can be formed concurrently with and by the same tool set-up as the groove 66 for the plug-retaining ring 64 so that a precise and uniform length dimension between those elements can be obtained early. Further, these parts are so arranged that they match the length of the core body 12, 18 and the corresponding length of the sleeve 42, and those lengths can also be controlled with high accuracy, so that a close match can be obtained between the length dimensions of the core body and the plug. It is no longer necessary to counterbore the face plate 20 to an accurate dimension after assembly, since the rear counterbore which forms the rabbet groove 70 need only have sufficiently close clearance to prevent escape of the retaining ring 64 from the groove 66 at the front of the plug 14. Further, because of these factors, it is readily possible to assemble the core body and the sleeve and the key plug 14 in a preliminary and temporary assembly, to then drill the pin tumbler bores 48 in all three parts while so assembled, then to disassemble the parts and clear them of burrs and chips, before final assembly of the parts with the retaining ring 64 and the face plate 20.

Accordingly, manufacture and assembly of the core in accordance with the present invention is relatively simple and easy. The several parts can be manufactured to final dimensions independently and with sufficient accuracy to permit subsequent random assembly. The core body 12, 18 may be temporarily assembled with a sleeve 42 and key plug 16, and the parts held in assembled position in a jig while the pin tumbler bores 48 are drilled in the three parts. The parts may then be disassembled and cleared of burrs and chips, and then reassembled together with a key stop segment 62 and a retaining ring 64. A face plate 20 is then mounted against the front of the assembly so as to enclose and trap the retaining ring 64 in place and fix the face plate 20 on the body by the blind rivet shown in FIGS. 3 and 4.

Further, when the core is to have a plated surface, there are further advantages relative to the prior standard core. In that prior standard core it was considered necessary to assemble the core body, face plate, sleeve, plug, and riveted rear key stop before plating, and then to plate that assembly. In the plating operation, plating metal inevitably entered the interfaces between the parts at which relative motion was to occur, and this produced variations in tolerances and caused the parts to bind and required special lubricants. In contrast, with the present construction it is feasible to plate the parts, or their desired surfaces, separately and before assembly, and subsequently to assemble the core with such pre-plated components. This avoids the problems which arose by reason of plating after assembly.

I claim:

1. A pin tumbler lock, comprising lock body means forming a key plug bore extending between front and rear faces and forming pin tumbler bores intersecting therewith, a key plug having a cylindrical portion received in said plug bore and containing an axial key slot and pin tumbler bores alignable with those of the body means, a peripheral flange on said plug integral with said cylindrical portion and disposed in thrust transmitting overlapping relation with the rear of the lock body means so as to oppose forward movement of the key plug, a circumferential groove in the key plug adjacent its front end and a retainer ring engaged in said groove and disposed in axially engaging relation with the front of the lock body so as to oppose rearward movement of the plug, said ring having a key-pass opening therein and interengaging the plug so as to be held with its said opening in alignment with the key slot of the key plug.

2. A lock as in claim 1 with the addition of a transverse slot in the cylindrical portion of the key plug, extending across the key slot thereof ahead of said peripheral flange so as to lie within the key plug bore of the lock body means, and a key stop segment in said transverse slot and trapped therein by the surrounding body means to form a key stop adjacent the rear end of the key slot.

3. A lock as in claims 1 or 2 with the addition of a face plate mounted at the front of said lock body means and including an annular portion surrounding said retainer ring and trapping the same in the key plug groove.

4. A lock as in claims 1 or 2, comprising a key-removable core including a core body having a key plug lobe and a lateral tumbler pin portion, a sleeve in said key plug lobe and having a core-retainer lug thereon movable between retaining and release positions by rotation of the sleeve, said sleeve defining the key plug bore and the key plug being mounted therein, the peripheral flange on said plug extending outward to overlap both the rear of the sleeve and at least a portion of the rear of the core body.

5. A lock as in claim 4 with the addition of a face plate mounted to the front of the core body and having an annular portion surrounding the front of the key plug and formed with a rear counterbore which contains the retainer ring and traps it in the groove of the key plug.

6. A lock as in claim 2 in which said transverse slot has a chordal bottom surface and said key stop segment has a flat inner edge and an arcuate outer edge adapted to ride in the key plug bore of the body means.

7. A lock as in claim 4 in which said core-retaining lug on the sleeve includes a forward facing shoulder adapted to engage behind a rearward facing shoulder in a core receptacle to retain the core against forward pull from the receptacle, said sleeve and lug extending rearward from said forward facing shoulder into thrust transmitting relation with said peripheral flange so as to transmit forward pull on said key plug from such flange to such shoulder.

8. A key-removable lock core having a key plug with improved pull resistance, comprising a core body having a key plug lobe and a lateral tumbler pin portion, a cylinder mounted for limited rotation in said key plug lobe and having a boss thereon forming a core retainer lug movable with such rotation between a core-retaining position and a core-release position, said boss and tumbler pin portion having an arcuate interface defining a control shear line, a key plug having a cylindrical portion rotatably received in said sleeve and defining with said sleeve an operating shear line, a peripheral flange integral with said cylindrical portion and disposed in thrust transmitting overlapping relation with said core body and sleeve from the rear so as to oppose forward displacement of the key plug relative to the body and sleeve, a circumferential groove in the key plug and a retainer ring engaged therein and radially overlapping said core body and sleeve at the front so as to oppose rearward displacement of the plug, said retainer ring having a key-pass opening and interengaging said plug so as to be held with such opening in alignment with the key slot, and means forming a key stop for said plug.

9. A core as in claim 8 in which the plug includes a transverse slot in its cylindrical portion adjacent the rear thereof and a key-stop segment mounted in said slot and trapped therein by the surrounding sleeve.

10. A core as set forth in claim 8 or 9 in which said lug-forming boss lies in rearward thrust transmitting relation with said plug flange and extends forward therefrom to a forward facing shoulder adapted to engage behind a rearward facing shoulder on a core receptacle to retain the core and key plug against forward pull therefrom.

11. A lock core, comprising lock body means forming a key plug bore extending between front and rear faces, a key plug having a cylindrical portion received in said bore and having an axial key slot therein, said plug being insertable from the rear to an operative position in said bore and having means for holding the plug against axial forward movement from said position, a circumferential groove in the key plug adjacent its front end, a retainer ring engaged in said groove and overlapping the front face of the lock body means so as to oppose rearward movement of the plug therein, said ring having a key-pass opening therein and interengaging the plug so as to be held with such opening in alignment with the key slot of the plug, and a face plate mounted to said lock body means and having an annular portion surrounding said retainer ring and trapping it against displacement from said groove.

12. A lock core as in claim 11 in which said lock body means has a key plug lobe and a side lobe containing pin tumbler bores and said face plate is a separate member, and fastener means fastening said face plate to said side lobe.

13. A lock as in claim 1, comprising a key-removable core including a core body having a key plug portion and a lateral tumbler pin portion, a sleeve on the axis of said key plug portion and having a core-retainer lug thereon movable between retaining and release positions by rotation of the sleeve, said sleeve defining at least a portion of the key plug bore and the key plug being rotatable therein, said core-retaining lug on the sleeve including a forward-facing shoulder adapted to engage behind a rearward-facing shoulder in a core receptacle to retain the core against forward pull from the receptacle, said sleeve closely surrounding said key plug ahead of the peripheral flange thereon so as to be in substantial axial alignment therewith and so that pull on said key plug will be transmitted in a substantially axial direction from such flange to the sleeve and thereby thrust the lug thereon against such rearward-facing shoulder in the core receptacle.

14. A key-removable lock core having a key plug with improved pull resistance, comprising a core body having a key plug lobe and a lateral tumbler pin portion, a cylinder mounted for limited rotation on the axis of said key plug lobe and having a boss thereon forming a core retainer lug movable with such rotation between a core-retaining position and a core-release position, said cylinder and tumbler pin portion having an arcuate interface defining a control shear line, a key plug having a cylindrical portion rotatably received in said sleeve and defining with said sleeve at least a portion of an operating shear line, a peripheral flange integral with said cylindrical portion and disposed at the rear of said core body and in overlapping axial alignment with portions of said core body and sleeve so as to transmit forward pull on the key plug from such flange to the body and sleeve, a circumferential groove in the key plug and a retainer ring engaged therein and radially overlapping at least a portion of said core body and sleeve at the front so as to oppose rearward displacement of the plug, said retainer ring having a key-pass opening and interengaging said plug so as to be held with such opening in alignment with the key slot, and means on said core for retaining said ring in position on said plug.

* * * * *